United States Patent [19]

Melfi

[11] 3,995,834

[45] Dec. 7, 1976

[54] SUPPORTS FOR GUARD RAILS

[76] Inventor: Samuel T. Melfi, 1601 NW. 1st Court, Boca Raton, Fla. 33432

[22] Filed: July 28, 1975

[21] Appl. No.: 599,400

[52] U.S. Cl. ..... 256/59; 24/263 A

[51] Int. Cl.[2] ..... E04H 17/14

[58] Field of Search ..... 24/263 SB, 263 A; 248/226 B, 226 C; 256/59, 65, DIG. 6

[56] References Cited

UNITED STATES PATENTS

| | | | |
|---|---|---|---|
| 2,195,366 | 3/1940 | Haigh | 248/226 B |
| 3,747,898 | 7/1973 | Warren | 256/59 |
| 3,756,568 | 9/1973 | Mocny et al. | 256/59 |

*Primary Examiner*—Werner H. Schroeder
*Assistant Examiner*—Doris L. Troutman
*Attorney, Agent, or Firm*—Erwin A. Yaeger

[57] ABSTRACT

A clamping arrangement for the support of temporary guard rails of the kind used on balconies, shaft openings, porches and other building parts, and particularly for use during building construction. The clamping means includes a tubular upright post carrying means for the support of guard rails. The post is fixed on a frame of inverted L-shape. Adjustably mounted on a leg of the frame are two clamping bars constituting jaws of the clamp. Stops are provided on the leg of the frame and they act to locate one of the clamping bars at one or more positions on the leg of the frame, the other clamping bar being moved to a co-operative clamping relation with the first bar by means of an adjustable threaded rod extending through the tubular post.

3 Claims, 3 Drawing Figures

SUPPORTS FOR GUARD RAILS

The present invention relates to clamps or supporting means for guard rails of a kind adapted to be fitted on balconies, shaft openings, porches and many other parts of buildings, and especially used during the construction work on a building. An arrangement of this character is shown in my U.S. Pat. No. 3,351,311, dated Nov. 7, 1967 and the present invention is an improvement over the means disclosed in the patent.

The present invention includes adjustable means by which the spacing between clamping elements or the size of a throat between such elements can be regulated in order to afford a more flexible use of the arrangement over the fixedly arranged clamp elements disclosed in the above patent.

The described device thus includes a frame of substantially inverted L-shape and which includes a part through which an adjusting rod is threadable, said part having a vertical leg on which two adjustable clamping bars or jaws are mounted for respective disposition above and below a concrete slab or other building part. One of the bars or jaws is adjustable by means of a threaded rod extending and threadable through an upright tubular post on the structure. The post is fixed at its lower end to an arm on the frame. The clamping bar includes a bracket that forms a shalf which accomodates a rail or so-called "toe board" to prevent the possible sliding of material over the edge of the concrete slab.

The second clamping bar of the device is adjustable between stops provided on the vertical leg of the frame.

Referring to the drawing.

Figure 1:
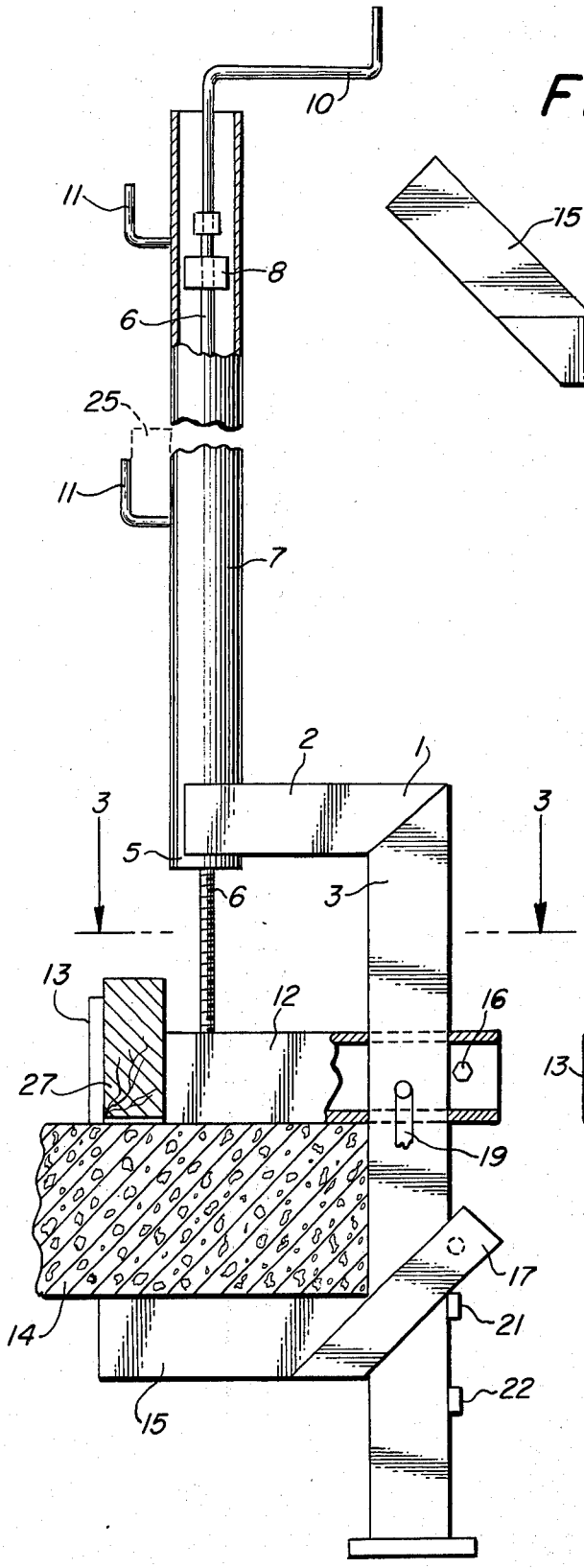
FIG. 1 is a side elevational view of the rail supporting device.

In the drawing, 1 indicates generally the fixed frame of the device, the same being substantially of inverted L-shape and including a horizontally disposed arm 2 and an attached vertical leg 3, the latter being arranged at right angles to the arm 2 and being provided at one end with the welded-on cap 4.

Welded at the end of arm 2 and bottom of post 7 is a nut 5 which adjustably receives a threaded rod 6 extending axially through a hollow upstanding post 7. The post 7 is fixed at its lower end to the arm 2 of the frame. Provided within the post near its upper end is a bearing 8 serving as a support and guide for the rod 6.

The upper end of the rod 6 is located within the post and below the upper end of the same, and is suitably shaped to receive a socket wrench 10, which, by being turned, will vertically adjust the rod 6. Provided on the post 7 are spaced hook-shaped supports or shelves 11 for the reception of horizontal guard rails or chains.

The lower end of the rod 6 is operative against the upper face of a first clamping bar or jaw 12 that is vertically slidable on the leg 3 of the frame 1. At its outer or free end, the clamping bar 12 carries an angle bracket of shelf 13 for the support of a rail or so-called toe board 27 which serves as a deterrent to the falling off of material over the edge of the concrete slab 14 that is accomodated between the clamping bars 12 and 15. The bar 12 includes a bolt 16 threadable through a nut welded on the clamping bar, the bolt serving to prevent tilting of the bar 12 on the frame leg 3, and enabling attachment and removal from leg 3.

The clamping bar 15 is provided with an angular arm 17 which embraces the leg 3 of the frame 1 and permits the up and down movement of the same relatively to the upper clamping bar 12. A C-shaped clamp is thus formed by the bars 12 and 15 and the leg 3 of the frame 1. The spacing between bars 12 and 15, constituting the throat of the clamp is thus adjustable to enable the concrete slab 14 to be securely gripped between the clamping bars 12 and 15. A locking L-shaped set screw rotated through a welded nut on bar 12 can be provided to restrict the adjusting movement of the bar 12.

Figure 2:
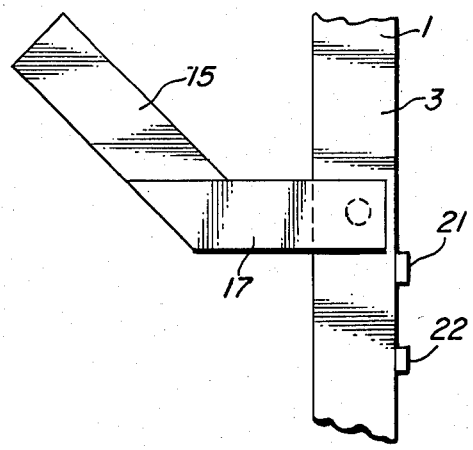
FIG. 2 shows how one of the clamping bars can be tilted to enable it to be moved along the leg of the frame from one stop to another.
Figure 3:
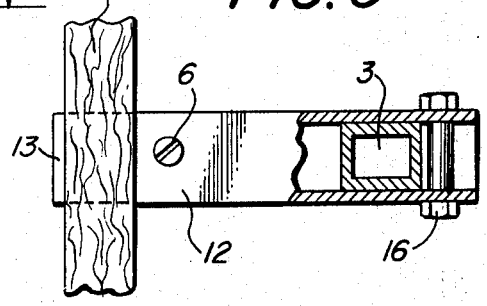
FIG. 3 is a sectional view taken substantially on the line 3—3, looking in the direction of the arrows.

The angular arm 17 includes a belt and welded nut on one arm for the retention and guidance of the bar 15 on the leg 3 and provided on the face of the frame leg 3 are stops 21 and 22 and as many as desirable in spaced relation. To permit the bar 15 to be raised or lowered from one stop to the other, the bar 15 can be swung upwardly to clear the stops as shown in FIG. 2, and it can then be slid along the leg 3 from one stop to any other desired stop.

The operation of the described structure will now be readily apparent. The lower clamping bar 15 may be adjusted on the leg 3 to position it above any one or the many others of the stops 21, 22 and below the concrete slab 14. The clamping bar 12 is on the top of the slab and by the turning of the rod 6 by means of the wrench 10, the rod 6 will force the clamping bar 12 downwardly against the upper face of the slab 14 so that the slab will then be firmly held between the clamping bars 12 and 15. The guard rails 25 can then be fitted in place in the rail supports 11 and the toe board is fitted on the bracket 27 through nail holes in arm 13.

The guard rails provide maximum protection for workmen or others on a balcony, porch or other places in a building. It will be understood that the clamps are placed at predetermined distances apart as desired, to thereby receive and support guard rails or chains of any required lengths and with advantages readily apparent to those skilled in this art.

What I claim is:

1. A clamp for guard rails comprising, a frame, a tubular post secured to and rising upwardly from the frame, said post being open at the top, a threaded rod extending axially through the post and adjustable therethrough from the upper end of the post, a first clamping bar slidable along the frame and held against a building element by pressure imposed on it by the threaded rod, said rod being adjustable from the top of the post to regulate such pressure, the post having means for supporting guard rails, a second clamping bar movably adjustable on the frame, said second adjustable clamping bar engaging the building element between it and the first clamping bar, the second clamping bar having an angular arm embracing the frame, said arm being slidably adjustable on the frame upon tilting movement of the second clamping bar.

2. A clamp for guard rails according to claim 1, wherein the post is open at the top and the threaded rod has an upper end terminating within the post below the open top of the same, said upper end of the rod being engageable within the post for applying rotative adjusting movement to the rod only by a tool inserted within the post to engage such upper end of the rod.

3. A clamp for guard rails comprising, an inverted L-shaped frame composed of horizontal and vertical connected leg portions, the horizontal leg portion being attached at its outer end to the lower end area of a vertical post, a threaded rod extending axially through the post, the post being open at the top, the rod having an upper end located within the post below the upper end of the post, a bar constituting a clamping jaw adjustable on the vertical leg portion of the frame, the threaded rod having a lower end for engagement against said clamping jaw to urge the same against a building element, a second bar vertically adjustable on the vertical leg portion of the frame and co-operative with the clamping jaw in clamping the building element between it and said clamping jaw, stops provided on the vertical leg portion of the frame to position the second bar at selected positions on the vertical portion, clips provided on the post for the reception of guard rails, and a flange provided on the clamping jaw to maintain a toe board between said flange and a part of the clamping jaw.

* * * * *